US012171350B2

(12) United States Patent
Pawlik et al.

(10) Patent No.: US 12,171,350 B2
(45) Date of Patent: Dec. 24, 2024

(54) TEMPERATURE-REGULATION RECEPTACLE SYSTEM

(71) Applicant: VoChill Inc., Austin, TX (US)

(72) Inventors: Randall Pawlik, Austin, TX (US); Lisa Pawlik, Austin, TX (US)

(73) Assignee: VoChill Inc., Austin, TX (US)

( * ) Notice: Subject to any disclaimer, the term of this patent is extended or adjusted under 35 U.S.C. 154(b) by 0 days.

(21) Appl. No.: 17/377,062

(22) Filed: Jul. 15, 2021

(65) Prior Publication Data

US 2023/0016795 A1 Jan. 19, 2023

(51) Int. Cl.
*A47G 23/02* (2006.01)
*B65D 25/02* (2006.01)

(52) U.S. Cl.
CPC ..... *A47G 23/0216* (2013.01); *B65D 25/02* (2013.01); *A47G 2023/0283* (2013.01)

(58) Field of Classification Search
CPC ..... A47G 2023/0283; A47G 23/02; A47G 23/0208; A47G 23/04; A47G 23/0216; A47G 2023/0275; B65D 25/106
USPC ..... 62/458
See application file for complete search history.

(56) References Cited

U.S. PATENT DOCUMENTS 2,838,916 A 6/1958 Planes Y Sola
4,978,004 A * 12/1990 Silverstein ..... B65D 43/0229 206/391
5,372,274 A 12/1994 Freedland
5,423,194 A * 6/1995 Senecal ..... A47G 23/04 62/458
2011/0174654 A1* 7/2011 Krasznai ..... A47J 43/0727 206/499
2016/0088962 A1 3/2016 Koshman
2020/0002079 A1* 1/2020 Pawlik ..... B65D 81/3881

FOREIGN PATENT DOCUMENTS

CN 206641692 11/2017
CN 210748519 6/2020
FR 2315246 A1 1/1977

OTHER PUBLICATIONS

International Application No. PCT/US2022/036254, International Search Report and Written Opinion of the International Searching Authority, Dated Oct. 21, 2022, 16 Pages.

* cited by examiner

*Primary Examiner* — Stephen J Castellano
(74) *Attorney, Agent, or Firm* — Baker Botts L.L.P.

(57) ABSTRACT

A temperature-regulation receptacle system, the system comprising: a receptacle system defining a recess for receiving a stemless drinking vessel, the receptacle system including: an outer receptacle, and an inner receptacle that is removably couplable to the outer receptacle, wherein the receptacle system comprises a top end portion, a bottom end portion, an inner wall portion, and an outer wall portion, the top end portion defining an opening of the recess, wherein at least a portion of the outer wall portion is continuous about the outer receptacle, wherein the inner wall portion extends between the top end portion and the bottom end portion, the inner wall portion having at least one curved surface between the top end portion and the bottom end portion.

20 Claims, 6 Drawing Sheets

TEMPERATURE-REGULATION RECEPTACLE SYSTEM

FIELD OF THE DISCLOSURE

The present disclosure relates to a temperature-regulation receptacle system for controlling and maintaining the temperature of a drink within a drinking vessel.

BACKGROUND

As a drink sits in a drinking vessel, the temperature of the drink rises or falls to ambient temperature instead of being maintained at, or changed to, a desired drinking temperature. Devices have been developed to maintain the temperature of a drink. One class of devices maintains a drink temperature by being inserted into the contents of the drinking vessel. Another class maintains temperature through beverage jackets (e.g., koozie, hugger, coozie). Another class is a specialized drinking vessel that itself is thermally insulated to maintain the temperature of the drink (e.g., tumbler or frozen glass). Another class includes tabletop containers that can chill a bottle of wine.

SUMMARY

Innovative aspects of the subject matter described in this specification may be embodied in a temperature-regulation receptacle system, the system comprising: a receptacle system defining a recess for receiving a stemless drinking vessel, the receptacle system including: an outer receptacle, and an inner receptacle that is removably couplable to the outer receptacle, wherein the receptacle system comprises a top end portion, a bottom end portion, an inner wall portion, and an outer wall portion, the top end portion defining an opening of the recess, wherein at least a portion of the outer wall portion is continuous about the outer receptacle, wherein the inner wall portion extends between the top end portion and the bottom end portion, the inner wall portion having at least one curved surface between the top end portion and the bottom end portion.

These and other embodiments may each optionally include one or more of the following features. For instance, the curved surface contacts the stemless drinking vessel. Only the curved surface contacts the stemless drinking vessel. The inner wall portion includes two or more curved surfaces between the top end portion and the bottom end portion. A first curved surface of the two or more curved surfaces has a first degree of curvature and a second curved surface of the two or more curved surfaces has a second degree of curvature, the second degree of curvature differing from the first degree of curvature. The inner receptacle further includes an egress positioned at the bottom end portion. The outer receptacle further includes a pass through opening positioned adjacent to the egress of the inner receptacle when the inner receptacle is coupled to the outer receptacle. The outer receptacle further including a tab that is flexible towards the inner receptable about a first end of the tab, the passthrough opening defined around the tab. Further comprising a stand for holding the receptacle system upright, the stand releasably attached to the outer receptacle. The stand includes a bottom portion and a lip extending away from the bottom portion, the bottom portion and the lip defining a reservoir. At least a portion of the inner wall portion is continuous about the inner receptacle that coincides with the continuous portion of the outer wall portion. A cavity is defined between the outer receptacle and the inner receptable. The receptacle system further includes a side opening extending laterally from the inner wall portion and the outer wall portion, and extends vertically from the top end portion and a surface spaced apart from the bottom end portion. Further comprising one or more frictional members positioned within respective cut-outs of the inner receptacle along the curved surface. The one or more frictional members contact the stemless drinking vessel when the stemless drinking vessel is positioned within the recess.

Innovative aspects of the subject matter described in this specification may be embodied in a temperature-regulation receptacle system, the system comprising: a receptacle system defining a recess for receiving a stemless drinking vessel, including: an outer receptacle, an inner receptacle that is removably couplable to the outer receptacle, and a stand for holding the receptacle system upright, the stand releasably attached to the outer receptacle, the stand including a bottom portion and a lip extending away from the bottom portion, the bottom portion and the lip defining a reservoir, wherein the receptacle system comprises a top end portion, a bottom end portion, an inner wall portion, and an outer wall portion, the top end portion defining an opening of the recess, wherein the inner receptacle includes an egress positioned at the bottom end portion, wherein the outer receptacle includes a pass through opening positioned adjacent to the egress when the inner receptacle is coupled to the outer receptacle, wherein the inner wall portion extends between the top end portion and the bottom end portion, the inner wall portion having at least one curved surface between the top end portion and the bottom end portion.

These and other embodiments may each optionally include one or more of the following features. For instance, only the curved surface contacts the stemless drinking vessel. The reservoir of the stand is in superimposition with the pass through opening of the outer receptacle and the egress of the inner receptacle when the stand is coupled to the outer receptacle. The inner wall portion includes two or more curved surfaces between the top end portion and the bottom end portion. A first curved surface of the two or more curved surfaces has a first degree of curvature and a second curved surface of the two or more curved surfaces has a second degree of curvature, the second degree of curvature differing from the first degree of curvature.

Innovative aspects of the subject matter described in this specification may be embodied in a method for decoupling of a temperature-regulation receptacle system, the method comprising: removing the receptacle system from a stand, the receptacle system including an inner receptacle and an outer receptacle; exerting a force on a first end of a tab formed in the outer receptacle such that the tab flexes about a second end of the tab opposite to the first end of the tab to contact the inner receptacle; and in response to exertion of the force, decoupling of the inner receptacle from the outer receptacle.

The details of one or more embodiments of the subject matter described in this specification are set forth in the accompanying drawings and the description below. Other potential features, aspects, and advantages of the subject matter will become apparent from the description, the drawings, and the claims.

BRIEF DESCRIPTION OF THE DRAWINGS

For a more complete understanding of the present disclosure and its features and advantages, reference is now made to the following description, taken in conjunction with the accompanying drawings, which depict various embodiments of the disclosure.

DETAILED DESCRIPTION

In the following description, details are set forth by way of example to facilitate discussion of the disclosed subject matter. It should be apparent to a person of ordinary skill in the field, however, that the disclosed embodiments are exemplary and not exhaustive of all possible embodiments.

As will be described in further detail, the inventors of the present disclosure have a temperature-regulation receptacle system for controlling and maintaining the temperature of a drink within a drinking vessel. The temperature-regulation receptacle system can allow for better and more convenient temperature control of the drink and thereby better enjoyment of the drink by a user.

A user may pour a drink into a drinking vessel and use the temperature-regulation receptacle system to maintain and control the temperature of the drink. A user may cool or warm the receptacle by placing the entire receptacle or one or parts/portions of the receptacle in a freezer or microwave, for example. After waiting for the receptacle (or the part of the receptacle) to reach a temperature, the user can remove the cooled or warmed receptacle and use the receptacle to hold a drinking vessel containing a drink. As the receptacle holds the drinking vessel, thermal energy is transferred from the drinking vessel to the cooled receptacle or from the heated receptacle to the drinking vessel. The receptacle, by holding the drinking vessel and transferring thermal energy, cools or warms the drinking vessel and maintains and controls the drink's temperature, prolonging the time the drink is cool or warm. The receptacle may be releasably attached to a stand to enable the receptacle to hold, for example, a stemless wine glass.

Figure 1:
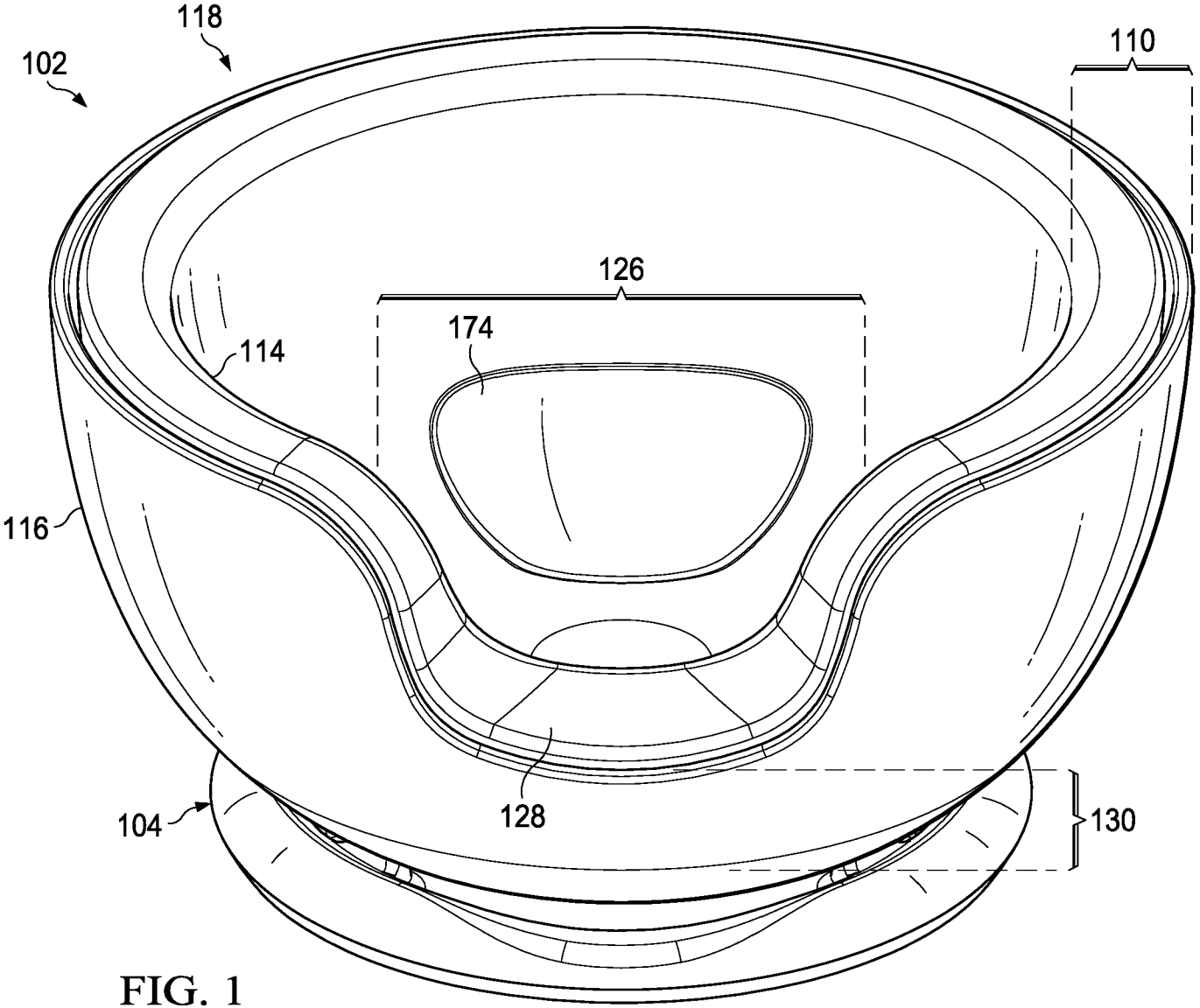
FIG. 1 illustrates a perspective view of a temperature-regulation receptacle system.

FIG. 1 illustrates a perspective view of a receptacle system 102 for regulating the temperature of a drink, and a stand 104. The receptacle system 102 can be used such that a user can control the temperature of a drink within a drinking vessel by placing the drinking vessel in the receptacle system 102. The receptacle system 102 can be releasably attached to the stand 104.

Figure 2:
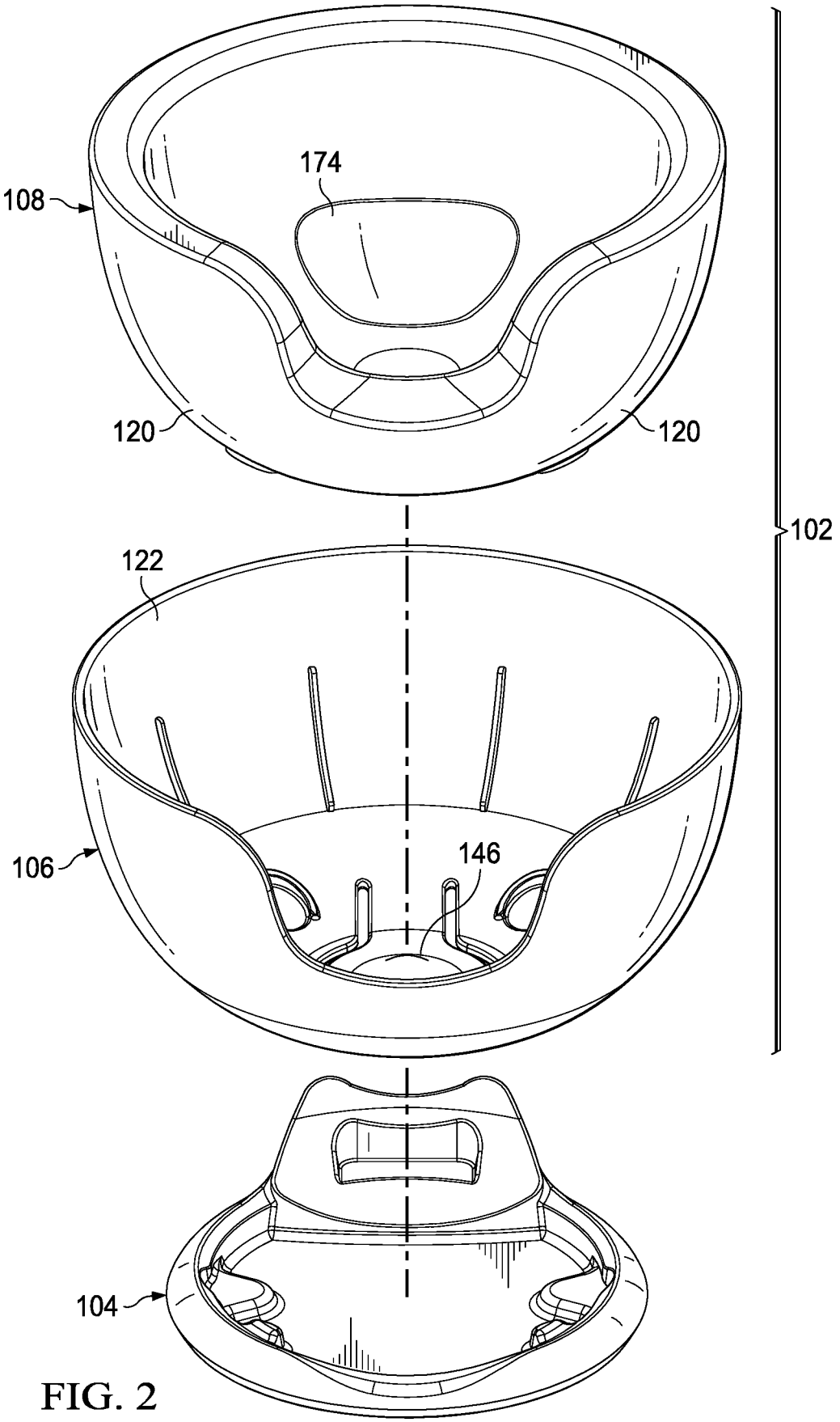
FIG. 2 illustrates an exploded perspective view of the temperature-regulation receptacle system.

FIG. 2 illustrates an exploded perspective view of the receptacle system 102, and the stand 104. The receptacle system 102 can include an outer receptacle 106 and an inner receptacle 108. The inner receptacle 108 can be removably coupled to the outer receptacle 106.

Figure 3:
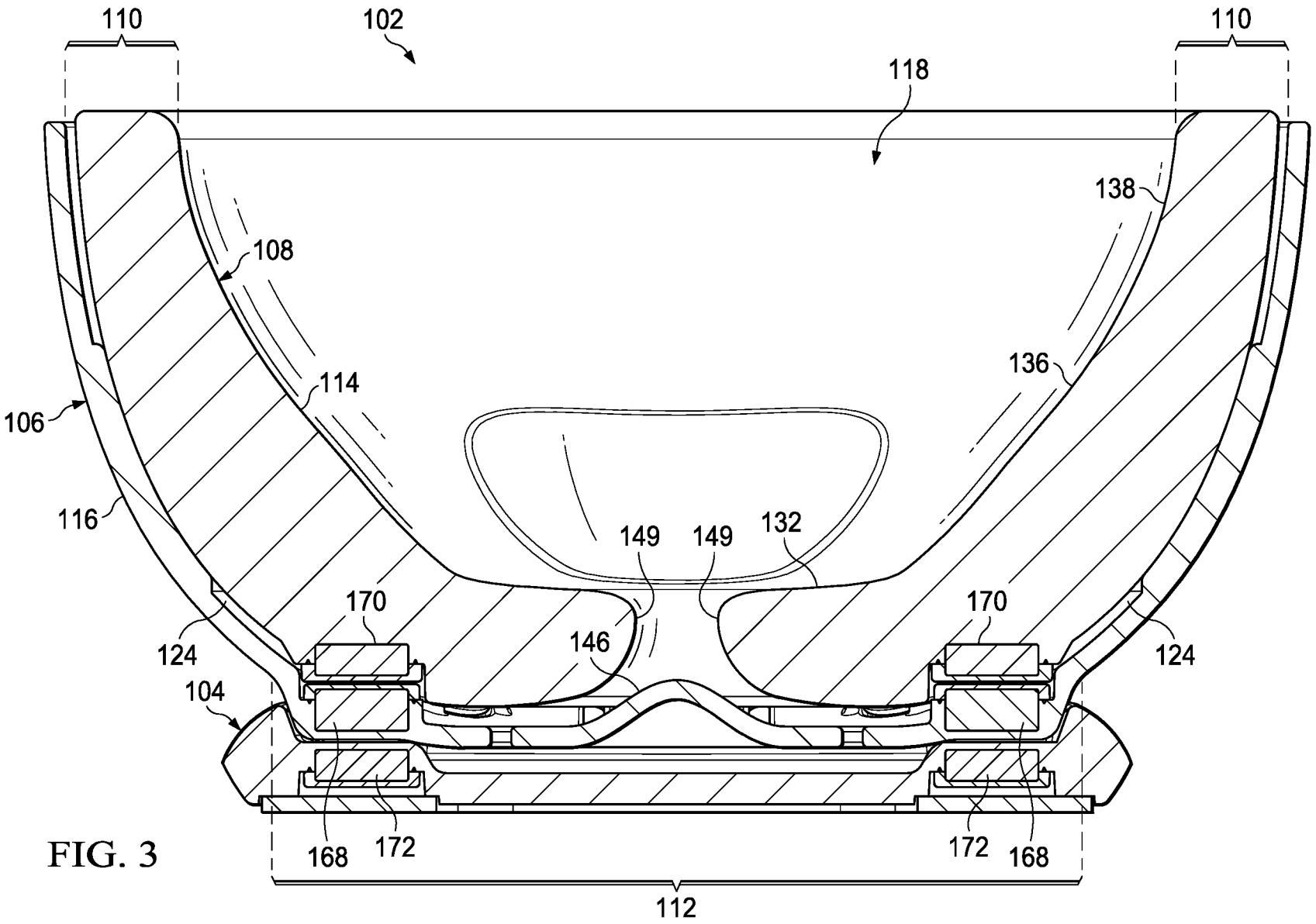
FIG. 3 illustrates a cut-away front view of the temperature-regulation receptacle system.

FIG. 3 illustrates a front cut-away view of the receptacle system 102. The receptacle system 102 comprises a top end portion 110, a bottom end portion 112, an inner wall portion 114, and an outer wall portion 116. The top end portion 110 defines an opening of a recess 118 to receive and hold a stemless drinking vessel. The recess 118 formed by the receptacle system 102, and in particular the top end portion 110, may take a variety of shapes and be contoured to define the recess 118 to receive a variety of drinking vessels having different shapes. In some examples, the inner wall portion 114 can extend between the top end portion 110 and the bottom end portion 112. In some examples, the outer wall portion 116 can extend between the top end portion 110 and the bottom end portion 112. The inner receptacle 108 can further include a bottom surface 132 adjacent to the bottom end portion 112.

Figure 4:
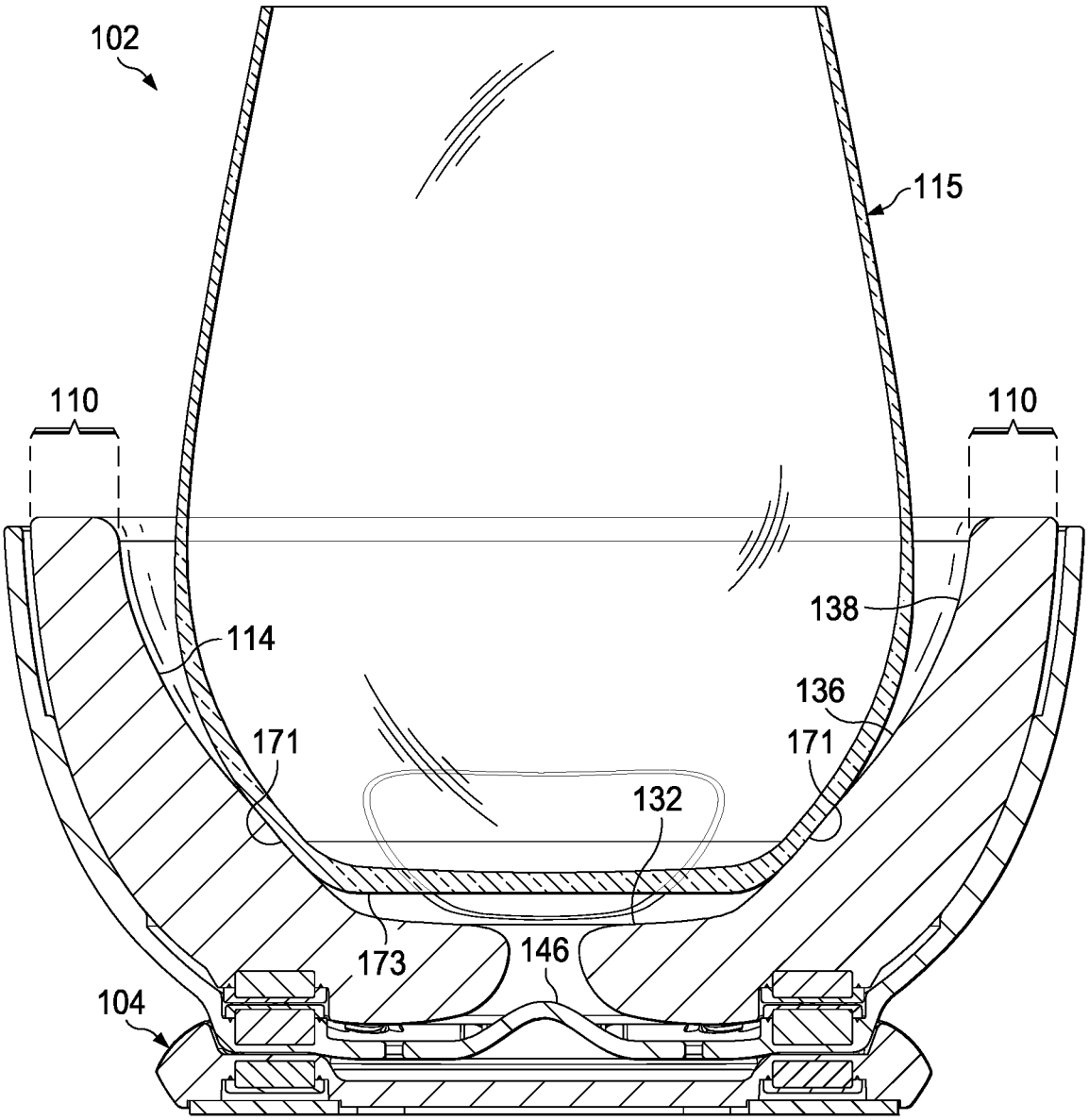
FIG. 4 illustrates a cut-away front view of the temperature-regulation receptacle system holding a stemless drinking vessel.

FIG. 4 illustrates a front cut-away view of the receptacle system 102 holding a stemless drinking vessel 115 (or drinking vessel 115). Specifically, the recess 118 of the receptacle system 102, shown in FIG. 3, can hold the stemless drinking vessel 115, with the inner wall portion 114 contacting the stemless drinking vessel.

Referring to FIGS. 1-4, in general, the receptacle system 102 controls or maintains a temperature of the drinking vessel 115 (and/or a liquid/drink contained by the drinking vessel 115) by contacting the drinking vessel 115. By contacting the drinking vessel 115, the receptacle system 102 can efficiently enable the transfer of thermal energy between the heated or cooled receptacle system 102, the drinking vessel 115, and the liquid (drink). Specifically, as the inner receptacle 108 is detachable from the outer receptacle 106, the inner receptacle 108 may be placed in a cooling environment (such as a freezer or refrigerator) or heating environment (such as an oven, microwave, or heat lamp) without the outer receptacle 106 and/or the stand 104. The cooling environment and heating environment may be any environment where the temperature is below or above room temperature, respectively. A user may save space in the cooling or heating environment by detaching the receptacle system 102 from the stand 104, and detaching the inner receptacle 108 from the outer receptacle 106 and placing only the inner receptacle 108 in the cooling or heating environment. In some examples, the receptacle system 102 including the outer receptacle 106 and the inner receptacle 108 can be placed in the cooling or heating environment. In some examples, the receptacle system 102 including the outer receptacle 106, the inner receptacle 108, and the stand 104 can be placed in the cooling or heating environment.

The inner receptacle 108 can include an inner surface 120 that is positioned opposite to the inner wall portion 114. The inner surface 120 can cover an entirety of the inner receptacle 108 extending from the top end portion 110. The outer receptacle 106 can include an inner surface 122 that is opposite to the outer wall portion 116. When the inner receptacle 108 is coupled to the outer receptacle 106, as shown in FIGS. 1 and 3, the inner surface 120 of the inner receptacle 108 is positioned opposite to the inner surface 122 of the outer receptacle 106. Furthermore, as shown in FIG. 3, when the inner receptacle 108 is coupled to the outer receptacle 106, a cavity 124 is defined between the inner receptacle 108 and the outer receptacle 106 and in particular, between the inner surface 120 of the inner receptacle 108 and the inner surface 122 of the outer receptacle 106. In some examples, the cavity 124 can collect condensation from the receptacle system 102.

In some cases, the receptacle system 102 can include a removable (material) layer (not shown) positioned between the inner receptacle 108 and the outer receptacle 106 when the inner receptacle 108 is coupled to the outer receptacle 108 (i.e., between the inner surface 120 of the inner receptacle 108 and the inner surface 122 of the outer receptacle 106). The removable layer can be flexible (non-rigid) that is configured to conform, at least partially, to the inner surface 120 of the inner receptacle and/or conform to the inner surface 122 of the outer receptacle 106. The removable layer can include an absorbent and/or insulating material such as, but not limited to cork, neoprene, felt, material comprised of natural or unnatural fibers, and/or any combination thereof. The removable layer may be positioned within the cavity 124 between inner surface 120 of the inner receptacle 108 and the inner surface 122 of the outer receptacle 106. The removable layer can be configured to collect/absorb/capture condensation at the inner surface 120 of the inner receptacle 108, the inner surface 122 of the outer receptacle 106 or both. The removable layer can further be configured to provide a thermal barrier between the outer receptacle 106 and the inner receptacle 108 to further reduce/minimize condensation on the outer wall portion 116.

In some examples, the inner receptacle 108 can be removably coupled to the outer receptacle 106 by one or more coupling means. For example, the inner receptacle 108 can "clip-in" to the outer receptacle 106 via one or more tabs of the inner receptacle 108 coupling with one or more tab interlocking members of the outer receptacle 106. For example, the inner receptacle 108 can be removably coupled to the outer receptacle 106 using any type of coupling members, such as screws, or other interlocking members. In some examples, the inner receptacle 108 is permanently coupled to the outer receptacle 106.

In some cases, the outer receptacle 106 may include an inner cavity that can be defined between the inner wall portion 122 and the outer wall portion 116 of the outer receptacle 106. The inner cavity of the outer receptacle 106 may contain and carry air or gasses. The inner cavity of the outer receptacle 106 may include an evacuated chamber. The evacuated chamber in the inner cavity of the outer receptacle 106 may have a pressure less than 600 Torr, less than $10^{-1}$ Torr, less than $10^{-2}$ Torr, less than $10^{-3}$ Torr, or less than $10^{-4}$ Torr. In some examples, the inner cavity of the outer receptacle 106 creates a thermal barrier or insulating jacket around the inner receptacle 108. This insulating jacket around the inner receptacle 108 further reduces/minimizes condensation on the outer wall portion 116 of the outer receptacle 106. The inner cavity of the outer receptacle 106 may allow for longer temperature retention of the inner receptacle 108, thereby increasing the time the temperature of a drink is controlled.

Referring to FIGS. 1, 2, and 4, the receptacle system 102 includes a side opening 126 along the inner receptacle 108 and the outer receptacle 106. Specifically, the side opening 126 extends i) between the inner wall portion 114 and the outer wall portion 116, and ii) between the top end portion 110 and a surface 128 spaced-apart from the bottom end portion 112. The side opening 126 can allow parts of the drinking vessel 115 to be viewed while the receptacle system 102 holds the drinking vessel 115. The side opening 126 allows the user to view their drink but is not so great in size as to eliminate the temperature control and maintenance benefits of the system. In some examples, the receptacle system 102 can include two or more side openings (similar to the side opening 126) along the inner receptacle 108 and the outer receptacle 106. The side opening 126 can have any geometric shape.

In some examples, a portion of the outer wall portion 116 is continuous about the outer receptacle 106, and a portion of the inner wall portion 114 is continuous about the inner receptacle 108 that coincides the continuous portion of the outer wall portion 116. Specifically, at the region 130 defined around the circumference of the receptacle system 102, the outer wall portion 116 and the inner wall portion 114 are continuous. In other words, the receptacle system 102 is contiguous at the region 130 around the perimeter of the receptacle system 102 and is independent of any breaks about the circumference of the receptacle system 102 and the outer wall portion 116 and the inner wall portion 114.

Referring to FIGS. 1 and 3, the inner wall portion 114 may also include a curved surface 136 between the top end portion 110 and the bottom end portion 112. The curved surface 136 can have any type of surface, including a smooth surface, a jagged surface, or combination thereof. The curved surface 136 contacts the drinking vessel 115, as shown in FIG. 4. In some examples, the curved surface 136 extends between the top end portion 110 and the bottom end surface 132. In some examples, the curved surface 136 extends completely (fully) between the top end portion 110 and the bottom end surface 132. In some examples, the curved surface 136 extends partially between the top end portion 110 and the bottom end surface 132. In some examples, the inner wall portion 114 can include a further curved surface 138 positioned adjacent to the curved surface 136. The degree of curvature of the curved surface 136 can differ from the degree of curvature of the further curved surface 138. In some examples, the degree of curvature of the curved surface 136 is greater than the degree of curvature of the further curved surface 138. In some examples, the degree of curvature of the curved surface 136 is less than the degree of curvature of the further curved surface 138. In some examples, the further curved surface 138 is positioned adjacent to the top end portion 110. In some examples, the further curved surface 138 is positioned adjacent to the bottom end portion 112. In some examples, the inner wall portion 114 can include multiple curved surfaces 138, each of varying degrees of curvature.

In some examples, the curved surface 136 (and/or the inner wall portion 114) may contact the drinking vessel 115 to hold/support the drinking vessel 115 by the receptacle system 102 and within the recess 118 of the receptacle system 102. Specifically, the curved surface 136 can contact sidewalls 171 of the drinking vessel 115, as shown in FIG. 4. In some examples, only the curved surface 136 contacts the drinking vessel 115 when the drinking vessel 115 is positioned within the recess 118 of the receptacle system 102. That is, the bottom surface 132 does not contact the drinking vessel 115 when the drinking vessel 115 is positioned within the recess 118 of the receptacle system 102 (the bottom surface 132 is independent of contacting the drinking vessel 115 when the drinking vessel 115 is positioned within the recess 118 of the receptacle system 102).

To that end, the receptacle system 102 can hold drinking vessels 115 of varying sizes and diameters. That is, as only the curved surface 136 contacts the drinking vessel 115 when the drinking vessel 115 is positioned within the recess 118 of the receptacle system 102, the receptacle system 102 can hold drinking vessels 115 of varying sizes and diameters.

Additionally, as a result of the curved surface 136 contacting the drinking vessel 115 when the drinking vessel 115 is positioned within the recess 118 of the receptacle system 102 (and/or only the curved surface 136 contacting the drinking vessel 115 when the drinking vessel 115 is positioned within the recess 118 of the receptacle system 102), the receptacle system 102, and in particular, the inner receptacle 108, can efficiently enable transfer of thermal energy from the drinking vessel 115 (and the liquid of the drinking vessel 115) to the receptacle system 102, and in particular the inner receptacle 108.

In particular, the sidewalls 171 of the drinking vessel 115 are generally thinner as compared a bottom surface 173 of the drinking vessel 115. As a result, transfer of thermal energy from the drinking vessel 115 (and the liquid of the drinking vessel 115) to the receptacle system 102, and in particular the inner receptacle 108, is more efficient through the sidewalls 171 of the drinking vessel 115 as compared to the bottom surface 173 of the drinking vessel 115. Thus, by the curved surface 136 contacting the drinking vessel 115 when the drinking vessel 115 is positioned within the recess 118 of the receptacle system 102 (and/or only the curved surface 136 contacting the drinking vessel 115 when the drinking vessel 115 is positioned within the recess 118 of the receptacle system 102), the receptacle system 102, and in particular, the inner receptacle 108, can increase an efficiency (or maximize an efficiency) of transfer of thermal energy from the drinking vessel 115 (and the liquid of the drinking vessel 115) to the receptacle system 102, and in particular the inner receptacle 108.

Figure 5:
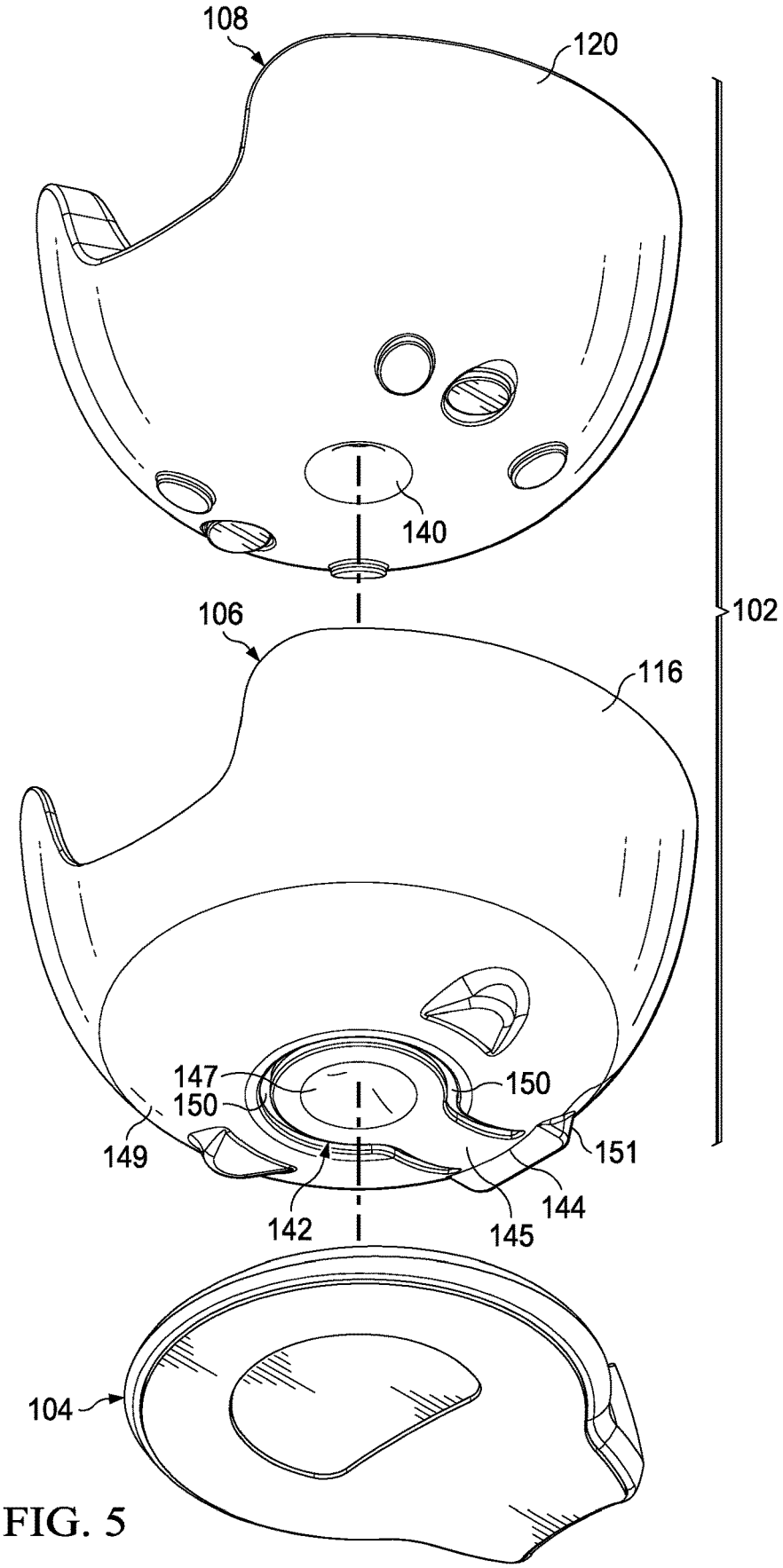
FIG. 5 illustrates a exploded bottom view of the temperature-regulation receptacle system.

FIG. 5 illustrates an exploded view of the receptacle system 102 and the stand 104. Referring to FIGS. 3 and 5, the inner receptacle 108 includes an egress 140 (weep hole) positioned at the bottom end portion 112 of the receptacle system 102. The egress 140 can extend through the bottom end portion 112 of the receptacle system 102, and in particular, through the bottom surface 132 of the inner receptacle 108. The egress 140 can include sidewalls.

Referring back to FIG. 5, the outer receptacle 106 can include a tab 142. The tab 142 can include a stem portion 145 and a contacting member 147. The contacting member 147 can be connected to the stem portion 145. As shown, the contacting member 147 is circular, but can include any geometric shape. The tab 142, and in particular the stem portion 145, is connected to the outer receptacle 106 at a first end 144. The stem portion 145 can be positioned at a second end 149 of the tab 142. The first end 144 is positioned opposite to the second end 149. The outer receptacle 106 can include two or more tabs 142, positioned in any configuration about the outer receptacle 106.

The tab 142 is flexible (or rotatable) about the first end 144. Specifically, the tab 142 is flexible about the first end 144 towards the inner receptacle 108. That is, when a force is exerted on the tab 142 (e.g., by a user), and in particular, the contacting member 147, towards the inner receptacle 108 (when the inner receptacle 108 is coupled to the outer receptacle 106), the contacting member 147 can make contact with the inner receptacle 108. Specifically, the contacting member 147 can make contact with the inner surface 120 of the inner receptacle 108. The contacting member 147 can further include a protrusion 146, as shown in FIGS. 2 and 3. The protrusion 146, when the user exerts a force on the tab 142, can contact the inner surface 120 of the inner receptacle 108.

A continuing force applied by a user to the tab 142, the contacting member 147, and the protrusion 146 can facilitate separation of the inner receptacle 108 from the outer receptacle 106. That is, the continuing force applied by a user to the tab 142, the contacting member 147, and the protrusion 146 can decouple and facilitate overcoming any coupling forces between the inner receptacle 108 and the outer receptacle 106 such that separation of the inner receptacle 108 from the outer receptacle 106 is facilitated.

In some examples, when the force is exerted on the tab 142 (e.g., by a user), and in particular, the contacting member 147, towards the inner receptacle 108 (when the inner receptacle 108 is coupled to the outer receptacle 106), the contacting member 147 can make contact with the egress 140, the sidewalls of the egress 140, and/or the inner surface 120 of the inner receptacle 108, as shown in FIG. 3. The protrusion 146, when the user exerts a force on the tab 142, can contact the egress 140, the sidewalls of the egress, and/or the inner surface 120 of the inner receptacle 108.

In some examples, the outer receptacle 106 can further include a pass through opening 150 (or opening 150). The opening 150 can substantially surround the tab 142 (the opening 150 can be defined around the tab 142). Specifically, the opening 150 can surround the contacting member 147, and/or the stem portion 145 (not including at the first end 144). The opening 150 can provide a separation between the tab 142 and the outer receptacle 106. In other words, the opening 150 can provide a gap between the tab 142 and the outer receptacle 106. When the inner receptacle 108 is coupled to the outer receptacle 106, the opening 150 can be positioned adjacent to the egress 140.

The outer receptacle 106 can further include a protruding coupling member 151. The protruding coupling member 151 can be positioned on the outer wall portion 116 of the outer receptacle 106. In some examples, the protruding coupling member 151 is positioned adjacent/proximate to the first end 144 of the tab 142.

Figure 6:
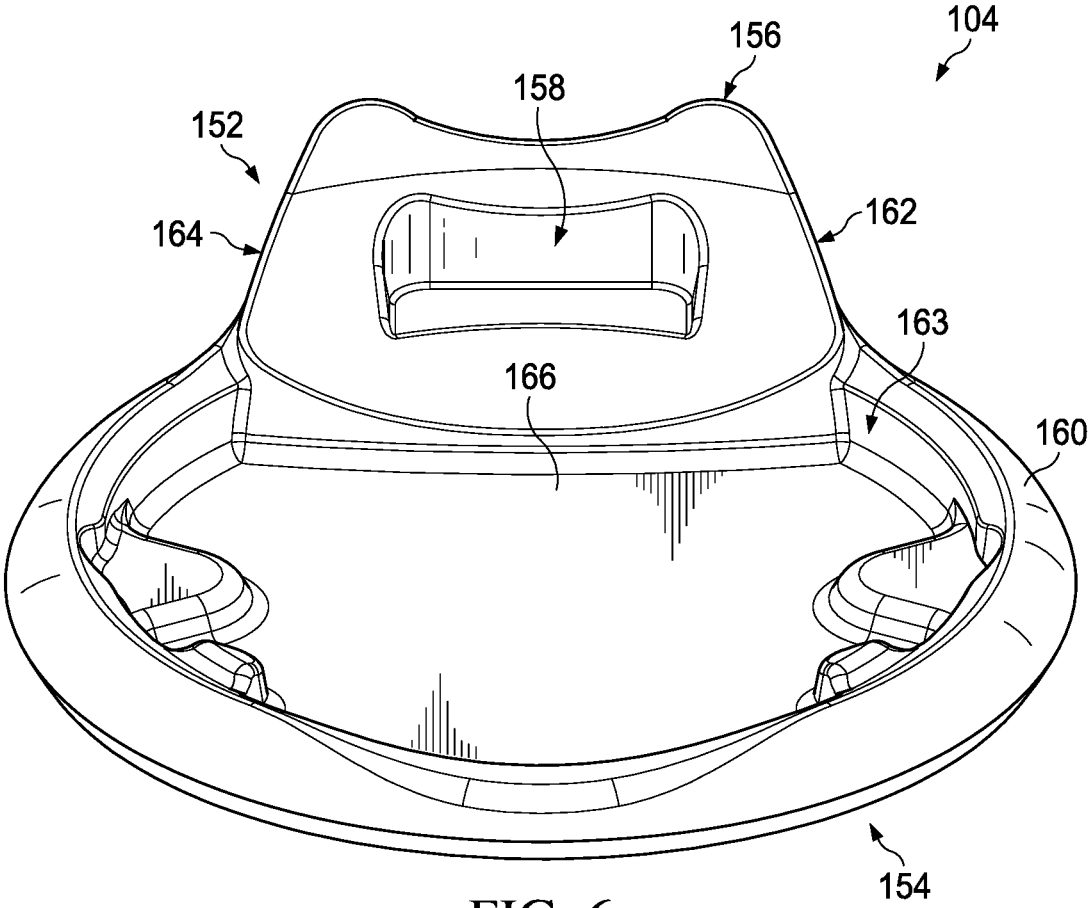
FIG. 6 illustrates a perspective view of a stand of the temperature-regulation receptacle system.

Referring to FIG. 6, the stand 104 can include a top end 152 positioned opposite to a bottom end 154. The bottom end 154 can include a bottom surface 166. The top end 152 can include at attaching member 156. The attaching member 156 can include a coupling recess 158.

Referring to FIGS. 5 and 6, when the receptacle system 102, and in particular, the outer receptacle 106, is coupled with the stand 104, the protruding coupling member 151 of the outer receptacle 106 is coupled with the attaching member 156. Specifically, the protruding coupling member 151 is positioned within the coupling recess 158 of the attaching member 156. As a result, the receptacle system 102 is coupled to the stand 104 such that the stand 104 can provide support for the receptacle system 102, including standing the receptacle system 102 "upright." The stand 104 is releasably attached to the outer receptacle 106.

The stand 104 can further include a lip 160 on a perimeter of the stand 104, and substantially surround the stand 104. The lip 160 can be positioned from a first end 162 of the attaching member 156 to a second end 164 of the attaching member 156. The lip 160 extends from the bottom end 154. To that end, the lip 160, the bottom surface 166, and the attaching member 156 can define a reservoir 163. When the receptacle system 102 is coupled to the stand 104, the reservoir 163 of the stand 104 is in superimposition with the opening 150 of the outer receptacle 106 and the egress 140 of the inner receptacle 108.

Referring to FIGS. 1, 3, 4, and 5, condensation may form on the inner receptacle 108—e.g., when the temperature of the inner receptacle 108 differs from that of room temperature (the temperature of the environment containing the receptacle system 102). To reduce unwanted user contact with condensation, the receptacle system 102 and the stand 104 may funnel such condensation into the reservoir 163. Specifically, the condensation that forms on the inner receptacle 108, and in particular, the inner surface 120 of the inner receptacle 108, may be captured in the reservoir 163 of the stand 104. That is, as the condensation forms on the inner surface 120 of the inner receptacle 108, the condensation may be directed toward the bottom end portion 112 of the receptacle system 102 and further directed thru the opening 150 of the outer receptacle 106 (e.g., due to gravitational force). The condensation may then egress thru the opening 150 of the outer receptacle 106 and become deposited within the reservoir 163 of the stand 104.

Furthermore, condensation may also form on the inner wall portion 114 of the inner receptacle 108. To reduce unwanted user contact with condensation, the receptacle system 102 and the stand 104 may funnel such condensation into the reservoir 163. Specifically, the condensation that forms on the inner wall portion 114 of the inner receptacle 108, and in particular, the curved surface 136 of the inner receptacle 108, may be captured in the reservoir 163 of the stand 104. That is, as the condensation forms on the inner wall portion 114 of the inner receptacle 108, the condensation may be directed toward the bottom end portion 112 of the receptacle system 102 and further directed thru the egress 140 of the inner receptacle 108 and the opening 150 of the outer receptacle 106 (e.g., due to gravitational force). The condensation may then egress thru the opening 150 of the outer receptacle 106 and become deposited within the reservoir 163 of the stand 104.

Furthermore, condensation may also form on the outer receptacle 106. To reduce unwanted user contact with condensation, the receptacle system 102 and the stand 104 may funnel such condensation into the reservoir 163. Specifically, the condensation that forms on the outer receptacle 106, and in particular, the outer wall portion 116 of the outer receptacle 106, may be captured in the reservoir 163 of the stand 104. That is, as the condensation forms on the outer wall portion 116 of the outer receptacle 106, the condensation may be directed toward the bottom end portion 112 of the receptacle system 102 (e.g., due to gravitational force). The condensation may then become deposited within the reservoir 163 of the stand 104.

Furthermore, condensation may also form on the inner surface 122 of the outer receptacle 106. To reduce unwanted user contact with condensation, the receptacle system 102 and the stand 104 may funnel such condensation into the reservoir 163. Specifically, the condensation that forms on the inner surface 122 of the outer receptacle 106 may be captured in the reservoir 163 of the stand 104. That is, as the condensation forms on the inner surface 122 of the outer receptacle 106, the condensation may be directed toward the bottom end portion 112 of the receptacle system 102 (e.g., due to gravitational force). The condensation may then egress thru the opening 150 of the outer receptacle 106 and become deposited within the reservoir 163 of the stand 104.

As such, condensation that can come into contact with a user of the receptacle system 102 and the stand 104, as well as the surface that the stand 104 is positioned on, can be minimized and/or prevented.

Referring to FIGS. 2, 3, and 5, in some examples, the inner receptacle 108 and the outer receptacle 106 include corresponding magnetic members to removably couple the inner receptacle 108 to the outer receptacle 106. For example, the inner surface 122 of the outer receptacle 106 can include a first set of magnetic members 168 and the inner surface 120 of the inner receptacle 108 can include a second set of magnetic members 170. The first set of magnetic members 168 can correspond to the second set of magnetic members 170. That is, when the inner receptacle 108 is positioned proximate to the outer receptacle 106, the corresponding sets of magnetic members 168 and 170 can be positioned proximate to one another such that the magnetic members 168 and 170 apply a magnetic coupling between the inner receptacle 108 and the outer receptacle 106. As such, the inner receptacle 108 is removably coupled to the outer receptacle 106 via magnetic forces between the magnetic members 168 and 170.

In some examples, the inner receptacle 108 can at least partially include a magnetic material, or formed from a magnetic material. Further, the outer receptacle 106 can include magnetic members to removably couple the inner receptacle 108 to the outer receptacle 106. For example, the inner surface 122 of the outer receptacle 106 can include magnetic members. When the inner receptacle 108 is positioned proximate to the outer receptacle 106, the magnetic members of the outer receptacle 106 apply a magnetic coupling with the magnetic material of the inner receptacle 108. As such, the inner receptacle 108 is removably coupled to the outer receptacle 106 via magnetic forces between the magnetic members of the outer receptacle 106 and the magnetic material of the inner receptacle 108.

In some examples, the outer receptacle 106 can at least partially include a magnetic material, or formed from a magnetic material. Further, the inner receptacle 108 can include magnetic members to removably couple the inner receptacle 108 to the outer receptacle 106. For example, the inner surface 120 of the inner receptacle 108 can include magnetic members. When the inner receptacle 108 is positioned proximate to the outer receptacle 106, the magnetic members of the inner receptacle 108 apply a magnetic coupling with the magnetic material of the outer receptacle 106. As such, the inner receptacle 108 is removably coupled to the outer receptacle 106 via magnetic forces between the magnetic members of the inner receptacle 108 and the magnetic material of the outer receptacle 108.

In some examples, the stand 104 further includes magnetic members 172 that correspond to the magnetic members 168 of the outer receptacle 106 to removably couple the outer receptacle 106 to the stand 104. In some examples, the stand 104 may be formed at least partially (or wholly) from a magnetic metal, a magnetic-based material, a composition of magnetic material and other non-magnetic material, or any combination thereof. When the receptacle system 102 is positioned proximate to the stand 104, the corresponding sets of magnetic members 168 and 172 can be positioned proximate to one another such that the magnetic members 168 and 172 apply a magnetic coupling between the outer receptacle 106 and the stand 104. As such, the receptacle system 102 is removably coupled to the stand 104 via magnetic forces between the magnetic members 168 and 172.

Referring to FIGS. 5 and 6, in some examples, the protruding coupling member 151 of the outer receptacle 106 and the recess 158 of attaching member 156 of the stand 104 can include corresponding magnetic members to couple the receptacle system 102 to the stand 104. For example, a surface of the protruding coupling member 151 can include a first set of magnetic members; and/or the magnetic members can be included within the protruding coupling member 151. In some examples, a surface of the recess 158 can include a second set of magnetic members. The first set of magnetic members of the protruding coupling member 151 can correspond to the set second of magnetic members of the recess 158. That is, when the receptacle system 102 is coupled to the stand 104, and specifically, the protruding coupling member 151 is positioned within the recess 158, the corresponding sets of magnetic members can be positioned proximate to one another such that the magnetic members apply a magnetic coupling between the protruding coupling member 151 and the recess 158. As such, the receptacle system 102 is removably coupled to the stand 104 via magnetic forces between the first set of magnetic members of the protruding coupling member 151 and the second set of magnetic members of the recess 158.

In some examples, the protruding coupling member 151 of the outer receptacle 106 can at least partially include a magnetic material, or formed from a magnetic material. Further, the recess 158 of the stand 104 can include magnetic members to removably couple the outer receptacle 106 to the stand 104. For example, a surface of the recess 158 can include magnetic members. When the protruding coupling member 151 is positioned within the recess 158, the magnetic members of the recess 158 apply a magnetic coupling with the magnetic material of the protruding coupling member 151. As such, the receptacle system 102 is removably coupled to the stand 104 via magnetic forces between the magnetic members of the recess 158 and the magnetic material of the protruding coupling member 151.

In some examples, the recess 158 of the stand 104 can at least partially include a magnetic material, or formed from a magnetic material. Further, the protruding coupling member 151 of the outer receptacle 106 can include magnetic members to removably couple the outer receptacle 106 to the stand 104. For example, a surface of the protruding coupling member 151 can include magnetic members. When the protruding coupling member 151 is positioned within the recess 158, the magnetic members of the protruding coupling member 151 apply a magnetic coupling with the magnetic material of the recess 158. As such, the receptacle system 102 is removably coupled to the stand 104 via magnetic forces between the magnetic members of the protruding coupling member 151 and the magnetic material of the recess 158.

Referring back to FIG. 3, the inner receptacle 108 can be formed from a solid, or substantially solid material. In some examples, the inner receptacle 108 can be at least partially hollow and/or include a cavity. The inner receptacle 108 can be configured to allow for efficient and long-lasting temperature control, insulation, or a combination thereof, e.g., of the drinking vessel 115 and/or the liquid contained by the drinking vessel 115. For example, the inner receptacle 108 (e.g., an inner cavity of the inner receptacle 108) may carry and contain a liquid solution. When placed in the freezer, the liquid solution may freeze, thereby increasing the time and degree of drink temperature control and maintenance.

The inner cavity of the inner receptacle 108 can be defined between the inner wall portion 114 and the inner surface 120 of the inner receptacle 108. The inner cavity of the inner receptacle 108 may contain and carry air or gasses. The inner cavity of the inner receptacle 108 may include an evacuated chamber. The evacuated chamber in the inner cavity of the inner receptacle 108 may have a pressure less than 600 Torr, less than $10^{-1}$ Torr, less than $10^{-2}$ Torr, less than $10^{-3}$ Torr, or less than $10^{-4}$ Torr. The inner cavity of the inner receptacle 108 may contain and carry solids, such as Styrofoam or plastic-coated wood. The inner cavity of the inner receptacle 108 may contain and carry a liquid solution such that the inner cavity of the inner receptacle 108 is partially or fully filled. The liquid solution may include water, gel such as alcohol gel, a solute, or a combination thereof. A liquid solution in the inner cavity of the inner receptacle 108 may have a freezing point, for example, above the temperature of household freezers. The inner cavity of the inner receptacle 108 may allow for longer temperature retention of the receptacle, thereby increasing the time the temperature of a drink is controlled. The inner cavity of the inner receptacle 108 may include an expansion area, allowing room for a solution to expand, such that a frozen solution does not exert sufficient pressure on the boundaries of the inner cavity 124 so as to damage the receptacle.

Referring to FIGS. 1 and 2, the receptacle system 102, and in particular, the inner receptacle 108 can include a frictional member 174. The frictional member 174 can be positioned within a cut-out (recess) of the inner receptacle 108 along the inner wall portion 114 (and/or the curved surface 136). A surface of the frictional member 174 can be flush with the inner wall portion 114 (and/or the curved surface 136). The frictional member 174 can be positioned between the top end 110 and the bottom end 112. In short, the frictional member 174 can contact the drinking vessel 115, shown in FIG. 4, when the drinking vessel 115 is positioned with the recess 118 of the receptacle system 102.

In some examples, the receptacle system 102 can include one or more separate and distinct frictional members 174 positioned along the inner wall portion 114 of the inner receptacle 108. In some examples, the receptacle system 102 can include one or more frictional members 174 positioned along the inner wall portion 114 of the inner receptacle 108 that are connected. In some examples, the frictional member 174 (or frictional members 174) cover a majority of the inner wall portion 114 of the inner receptacle 108. In some examples, the frictional member 174 (or frictional members 174) cover an entirety of the inner wall portion 114 of the inner receptacle 108. In some examples, the receptacle system 102 includes two or more frictional members 174.

Figure 7:
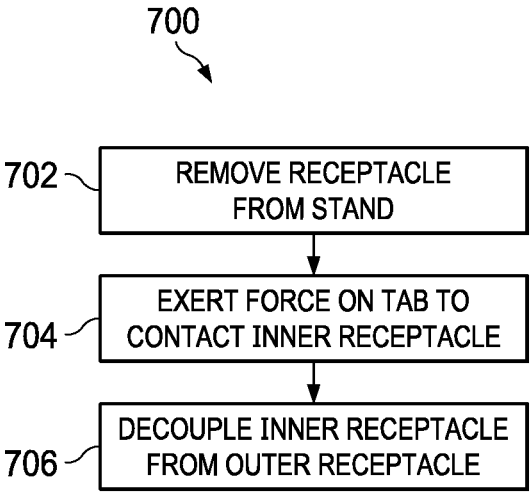
FIG. 7 illustrates a flowchart of decoupling of the temperature-regulation receptacle system.

The frictional member 174 can have any geometric shape to minimize, if not prevent, movement/translation/rotation of the drinking vessel 115 when the drinking vessel 115 is positioned with the recess 118 of the receptacle system 102. In some examples, the frictional member 174 is removable from the receptacle system 102. In some examples, the frictional member 174 is permanently coupled to the receptacle system 102. In some examples, the frictional member 174 is formed from one or more of thermoplastics, TPE (thermoplastic elastomer), TPU (thermoplastic urethane), silicone, rubber, foam rubber, cork, cork/rubber composite, vinyl foam, polyethylene foam, neoprene, urethane, felt/natural and synthetic fiber, low-durometer coating, and/or High Coefficient of Friction (COF) coatings/materials. In some examples, the frictional member 174 is formed from any combination of thermoplastics, TPE (thermoplastic elastomer), TPU (thermoplastic urethane), silicone, rubber, foam rubber, cork, cork/rubber composite, vinyl foam, polyethylene foam, neoprene, urethane, felt/natural and synthetic fiber, low-durometer coating, and/or High Coefficient of Friction (COF) coatings/materials FIG. 7 is a flow chart of an exemplary method 700 for decoupling of a temperature-regulation receptacle system. The method may use components and systems as described elsewhere in this disclosure. For example, the method may use the receptacle system 102 and/or the stand 104 as described with respect to FIGS. 1-6.

The receptacle system 102 is removed from the stand 104 (702). A force is exerted on the end 149 of the tab 142 such that the tab 142 flexes about the end 144 to contact the inner receptacle 108 (704). In response to the exertion of the force, the inner receptacle 108 is decoupled from the outer receptacle 106 (706).

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents and shall not be restricted or limited by the foregoing detailed description.

The invention claimed is:

1. A temperature-regulation receptacle system, the system comprising:

a receptacle system defining a recess configured for receiving a stemless drinking vessel, the receptacle system including:

an outer receptacle, and an inner receptacle that is removably couplable to the outer receptacle, wherein the receptacle system comprises a top end portion, a bottom end portion, an inner wall portion, and an outer wall portion, the top end portion defining an opening of the recess, and comprises at least one side opening extending laterally from the inner wall portion and the outer wall portion, and extending vertically from the top end portion and a surface spaced apart from the bottom end portion, and the inner receptacle comprises an egress at the bottom end portion of the receptacle system, wherein at least a portion of the outer wall portion is continuous about the outer receptacle and contiguous at a region near the side opening and around a perimeter of the receptacle system and independent of any breaks about the circumference of the receptacle system and the outer wall portion and the inner wall portion, wherein the inner wall portion extends between the top end portion and the bottom end portion, the inner wall portion including multiple curved surfaces, each of varying degrees of curvature and of which at least one first curved surface is between the top end portion and the bottom surface of the bottom end portion, wherein a degree of curvature of the at least one first curved surface differs from a degree of curvature of the multiple curved surfaces, wherein the at least one first curved surface contacts the stemless drinking vessel to transfer thermal energy between the receptacle system and the stemless drinking vessel to cool or warm the stemless drinking vessel.

2. The system of claim 1, wherein only the at least one first curved surface contacts the stemless drinking vessel when the stemless drinking vessel is positioned within the recess of the receptacle system.

3. The system of claim 1, wherein the egress extends through the bottom end portion of the receptacle system.

4. The system of claim 3, wherein the outer receptacle further includes a pass through opening positioned adjacent to the egress of the inner receptacle when the inner receptacle is coupled to the outer receptacle.

5. The system of claim 4, the outer receptacle further including a tab that rotates towards the inner receptacle about a first end of the tab, the passthrough opening defined around the tab.

6. The system of claim 1, further comprising a stand for holding the receptacle system upright, the stand releasably attached to the outer receptacle.

7. The system of claim 6, wherein the stand includes a bottom portion and a lip extending away from the bottom portion, the bottom portion and the lip defining a reservoir.

8. The system of claim 1, wherein at least a portion of the inner wall portion is continuous about the inner receptacle that coincides with the continuous portion of the outer wall portion.

9. The system of claim 1, wherein a cavity is defined between the outer receptacle and the inner receptacle.

10. The system of claim 1, wherein the at least one side opening extends between the inner wall portion and the outer wall portion and between the top end portion and the surface spaced-apart from the bottom end portion.

11. The system of claim 1, further comprising one or more frictional members positioned within respective cut-outs of the inner receptacle along the curved surface.

12. The system of claim 11, wherein the one or more frictional members contact the stemless drinking vessel when the stemless drinking vessel is positioned within the recess.

13. The system of claim 1, wherein the inner receptacle includes a curved bottom surface adjacent to the bottom end portion and to the egress, wherein the bottom surface of the bottom end portion is independent of contacting the stemless drinking vessel when the stemless drinking vessel is positioned within the recess of the receptacle system.

14. A temperature-regulation receptacle system, the system comprising:

a receptacle system defining a recess configured for receiving a stemless drinking vessel, including:

an outer receptacle, an inner receptacle that is removably couplable to the outer receptacle, a stand for holding the receptacle system upright, the stand releasably attached to the outer receptacle, the stand including a bottom portion and a lip extending away from the bottom portion, the bottom portion and the lip defining a reservoir, wherein the receptacle system comprises a top end portion, a bottom end portion, an inner wall portion, and an outer wall portion, the top end portion defining an opening of the recess, and comprises at least one side opening extending laterally from the inner wall portion and the outer wall portion, and extending vertically from the top end portion and a surface spaced apart from the bottom end portion, wherein at least a portion of the outer wall portion is continuous about the outer receptacle and contiguous at a region near the side opening and around a perimeter of the receptacle system, wherein the inner receptacle includes a bottom surface adjacent to the bottom end portion and an egress positioned at the bottom end portion, wherein the outer receptacle includes a pass through opening positioned adjacent to the egress when the inner receptacle is coupled to the outer receptacle, wherein the inner wall portion extends between the top end portion and the bottom end portion, the inner wall portion having at least one first curved surface between the top end portion and the bottom surface of the bottom end portion, wherein the inner wall portion includes a second curved surface positioned adjacent to the at least one first curved surface and the top end portion, each of the at least one first curved surface and the second curved surface having varying degrees of curvature, wherein the at least one first curved surface contacts the stemless drinking vessel to transfer thermal energy between the receptacle system and the stemless drinking vessel to cool or warm the stemless drinking vessel.

15. The system of claim 14, wherein only the at least one first curved surface contacts the stemless drinking vessel when the stemless drinking vessel is positioned within the recess of the receptacle system.

16. The system of claim 14, wherein the reservoir of the stand is in superimposition with the pass through opening of the outer receptacle and the egress of the inner receptacle when the stand is coupled to the outer receptacle.

17. The system of claim 14, wherein the inner wall portion includes multiple curved surfaces between the top end portion and the bottom end portion.

18. The system of claim 17, wherein the at least one first curved surface of the multiple curved surfaces has a first degree of curvature and the second curved surface of the multiple curved surfaces has a second degree of curvature, the second degree of curvature differing from the first degree of curvature.

19. The system of claim 14, wherein the at least one side opening is along the inner receptacle and the outer receptacle.

20. The system of claim 14, wherein the inner receptacle includes a curved bottom surface adjacent to the bottom end portion and to the egress, wherein the bottom surface of the bottom end portion is independent of contacting the stemless drinking vessel when the stemless drinking vessel is positioned within the recess of the receptacle system.

* * * * *